US005161509A

United States Patent [19]

Krieger et al.

[11] Patent Number: 5,161,509

[45] Date of Patent: Nov. 10, 1992

[54] FUEL INJECTION PUMP

[75] Inventors: Klaus Krieger, Affalterbach; Karl-Friedrich Rüsseler, Ditzingen; Michael Scharf, Renningen, all of Fed. Rep. of Germany

[73] Assignee: Robert Bosch GmbH, Stuttgart, Fed. Rep. of Germany

[21] Appl. No.: 721,660

[22] PCT Filed: Nov. 24, 1990

[86] PCT No.: PCT/DE90/00906

§ 371 Date: Jul. 22, 1991

§ 102(e) Date: Jul. 22, 1991

[87] PCT Pub. No.: WO91/10055

PCT Pub. Date: Jul. 11, 1991

[30] Foreign Application Priority Data

Dec. 29, 1989 [DE] Fed. Rep. of Germany ..... 3943297

[51] Int. Cl.[5] ..... F02D 31/00; F02M 41/00; F02M 37/04

[52] U.S. Cl. ..... 123/449; 123/502; 123/373

[58] Field of Search ..... 123/449, 502, 503, 373, 123/179.16

[56] References Cited

U.S. PATENT DOCUMENTS 4,483,297 11/1984 Eheim et al. ..... 123/449
4,509,470 4/1985 Ito et al. ..... 123/179.16
4,513,715 4/1985 Braun et al. ..... 123/503
4,548,184 10/1985 Laufer et al. ..... 123/449
4,615,317 10/1986 Bofinger et al. ..... 123/179.16
4,699,108 10/1987 Rouse et al. ..... 123/503
4,819,606 4/1989 Kawano et al. ..... 123/502

*Primary Examiner*—E. Rollins Cross
*Assistant Examiner*—Thomas N. Moulis
*Attorney, Agent, or Firm*—Edwin E. Greigg; Ronald E. Greigg

[57] ABSTRACT

A fuel injection pump having a speed governor which is housed in a pump body under a control pressure and which actuates an injection quantity control element, and a hydraulic injection timing mechanism which is connected with the pump body and which adjusts the start of injection (SB) to "early" with increasing pressure in the pump body, and to "late" with decreasing pressure. For the implementation of a load-dependent start of delivery (LFB), a governor sleeve of the speed governor governs in a load dependent manner, a relief throttle in the pump body, which, depending on the displacement setting of the governor sleeve, uncovers a varying cross-sectional throttle area to an outlet bore. In order to achieve clean exhaust gas in all load ranges, the relief throttle is designed so that the uncovered cross-sectional area of the throttle in a displacement setting (VL) assumed by the governor sleeve at full load, is zero or is very small, and that in a part load setting (TL) it is large, and that in a no-load or idling setting (NL) it is again smaller. Thus, the start of injection (SB) at no-load as opposed to part load, is adjusted once more to "early", albeit not so early as in the full load case.

10 Claims, 5 Drawing Sheets

FIG.3a
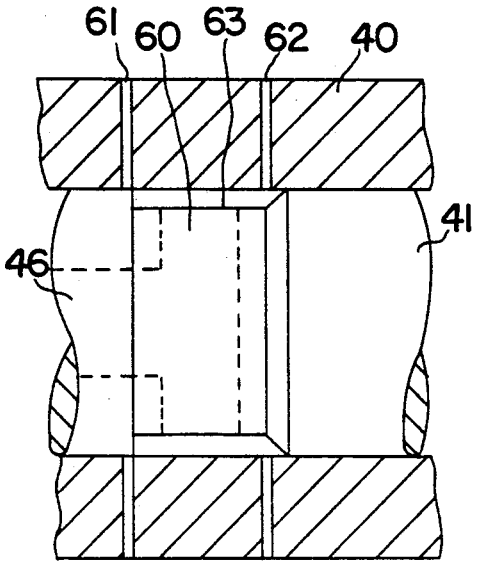
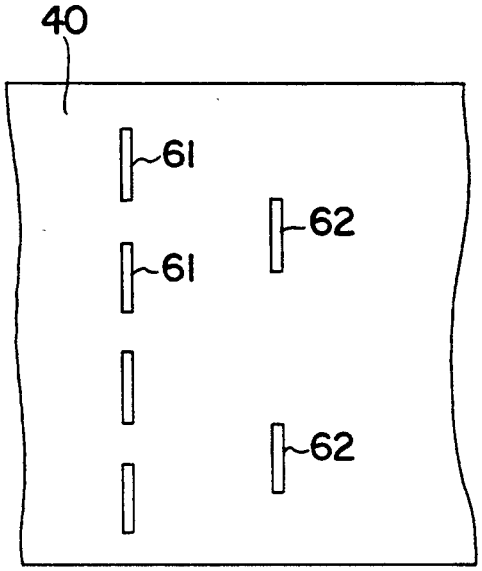
FIG.4
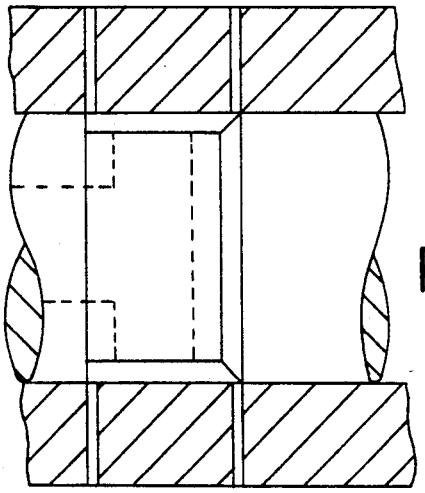
FIG.3b
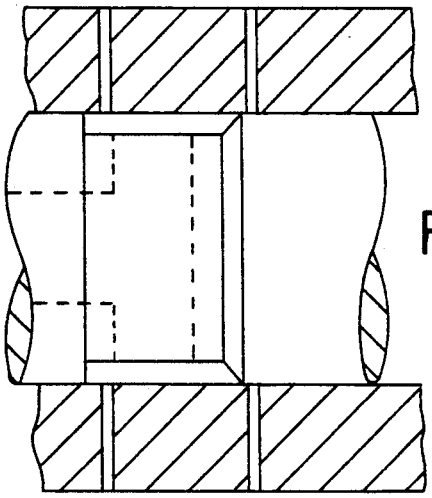
FIG.3c 40
72
71
72
71
73
74
41
46

FUEL INJECTION PUMP

STATE OF TECHNOLOGY

The invention is directed to a fuel injection pump of a distributor type construction for internal combustion engines.

A fuel injection pump of this type (DE 37 44 618 C1) is known where the throttle cross-sectional area is set in such a way that it increases with increasing displacement of the governor sleeve from the full load position to the no-load or idling position. With the respective throttle cross-section, the fuel pressure in the pump body is progressively lowered. Thus, the control pressure operating on the injection timing piston drops, and the injection timing piston of the injection timing mechanism, which is under the restoring force of a return spring, is pushed back and adjusts the start of delivery, and thus the start of injection, progressively in the direction of "late". The outlet duct for the discharge of fuel from the pump body, for the purpose of reducing the control pressure, extends in the interior of a so-called governor axis on which the governor sleeve slides, and is connected with a radial hole which opens out at the perimeter of the governor axis The various throttle cross-sections are set via two radial holes in the governor sleeve which are spaced at such an axial distance from one another that with progressive displacement of the governor sleeve, first one and then both holes are linked with the radial holes of the controller axis.

ADVANTAGES OF THE INVENTION

The fuel injection pump in accordance with the invention has the advantage that, starting from the full load position with progressive relief of the engine load, the start of the injection timing is adjusted to "late", but that at the no-load point or at idling, the start of injection is once again set to "earlier", albeit not quite so "early" as the start of injection under full load condition. By this means, good fuel processing and combustion is ensured, and clean exhaust is achieved in all load ranges.

As set forth, three different variations are given of how in the three load positions "full load", "part-load", "no-load" or "idling", the desired setting of the relief throttle can be set by displacing the governor sleeve. Here, the design of the device has the advantage that the load ranges can be relatively easily varied in size and position, even retrospectively, with the amount of final adjustment required being relatively small. In the examples set forth, these load ranges are given as fixed values, and cannot be subsequently altered, however, the construction costs are lower.

DRAWING

The invention is explained in more detail below, by means of the design examples represented in the drawing. The figures show the following:

Figure 1:
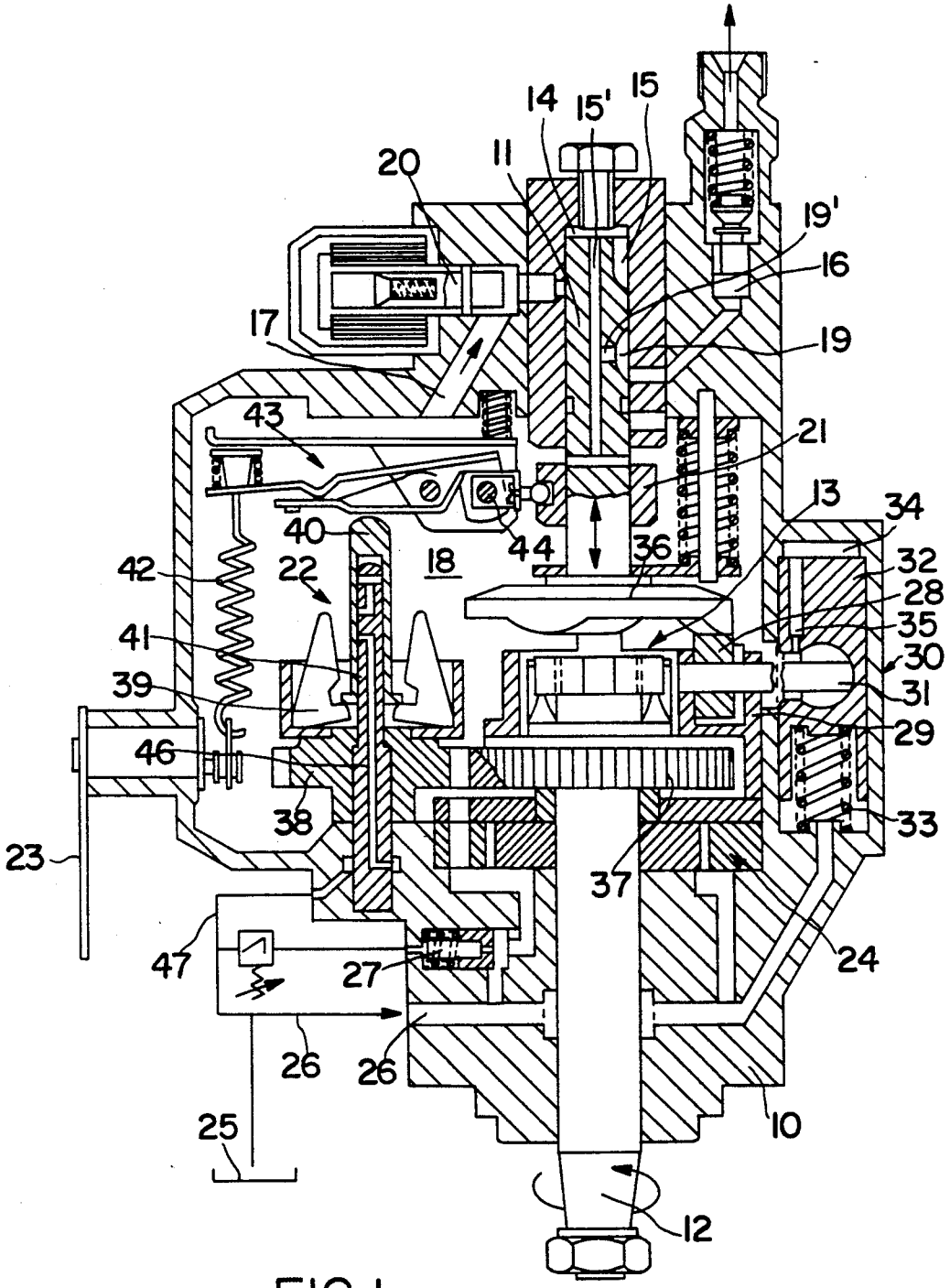
FIG. 1 shows a longitudinal section of a fuel injection pump of the distributor type construction, schematically represented.
Figure 2:
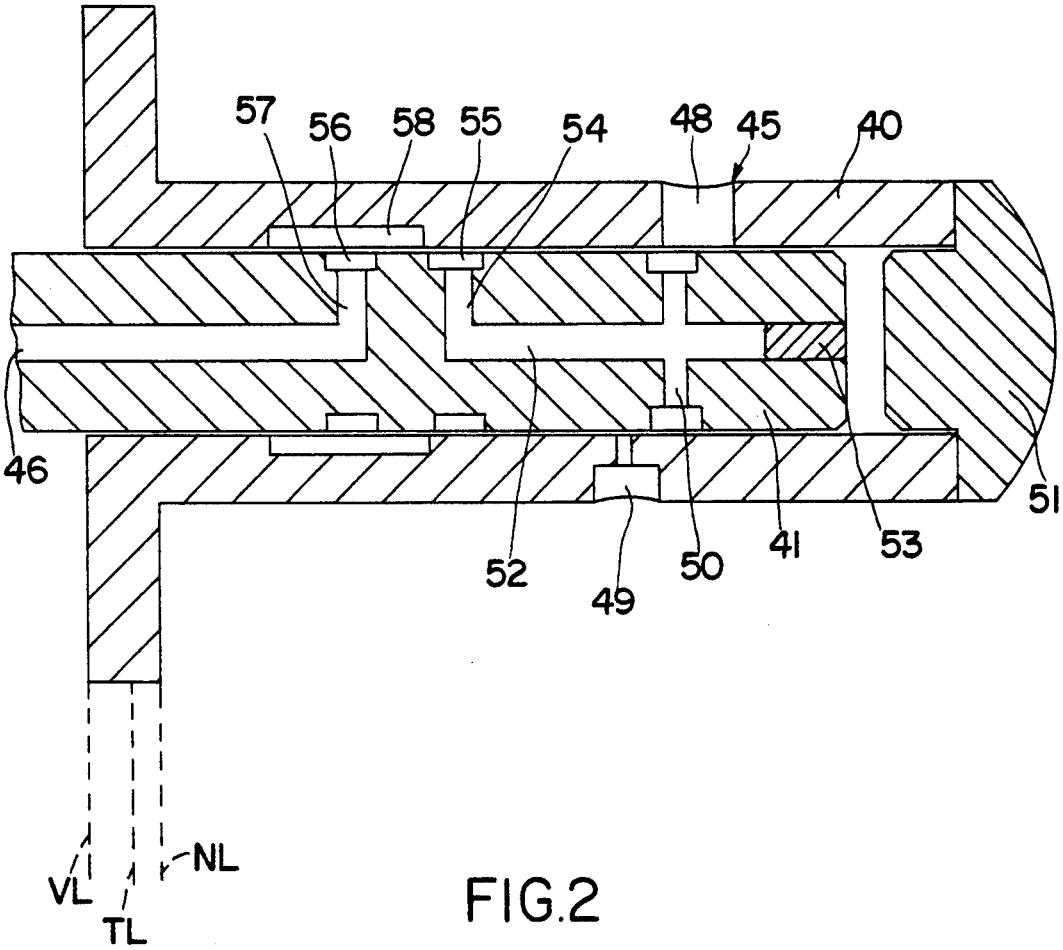
FIG. 2 shows part of a longitudinal section of the governor sleeve and the governor axis for the fuel injection pump in an enlarged view in FIG. 1.
Figures 5A, 5B, 5C:
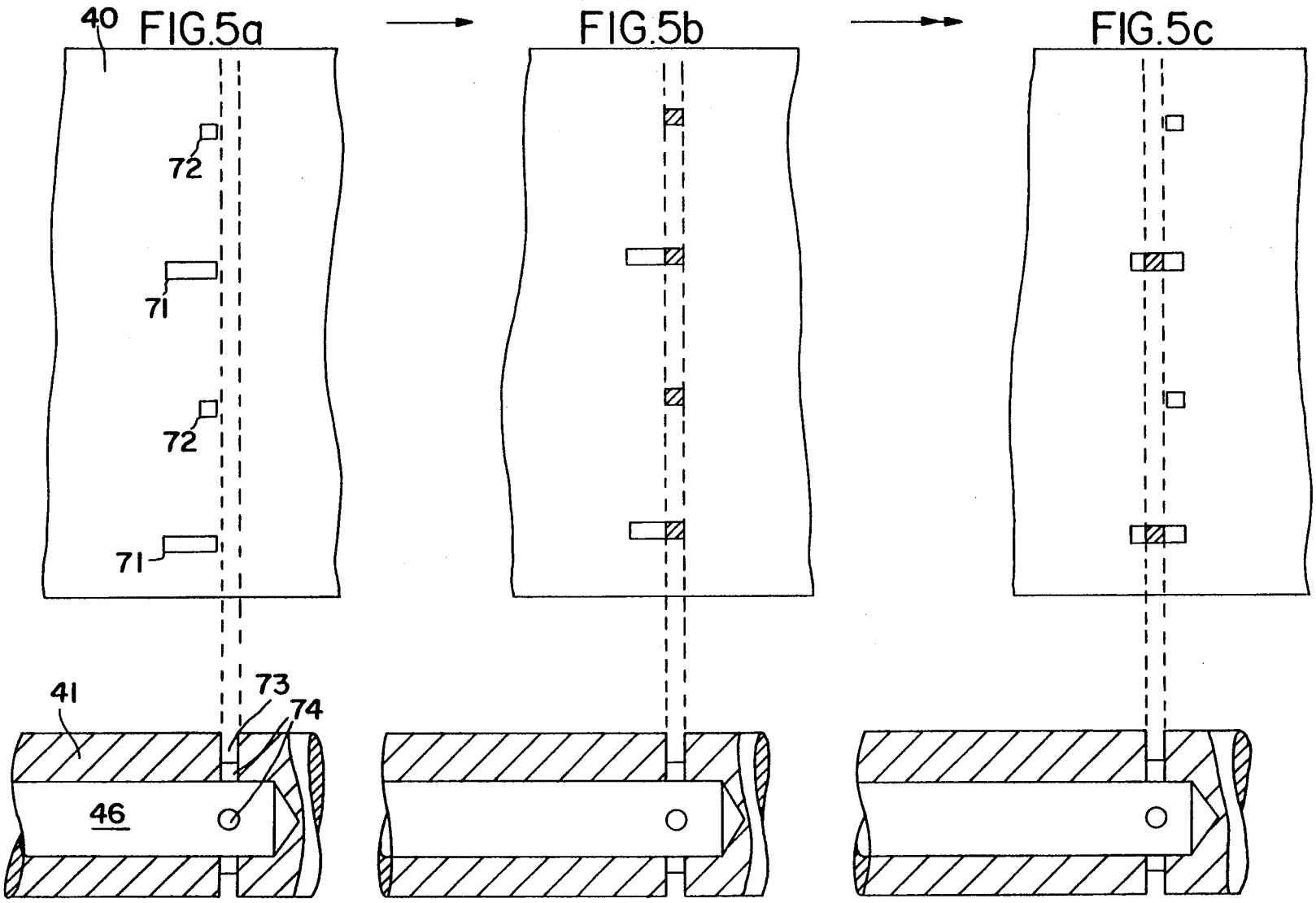
Figure 6:
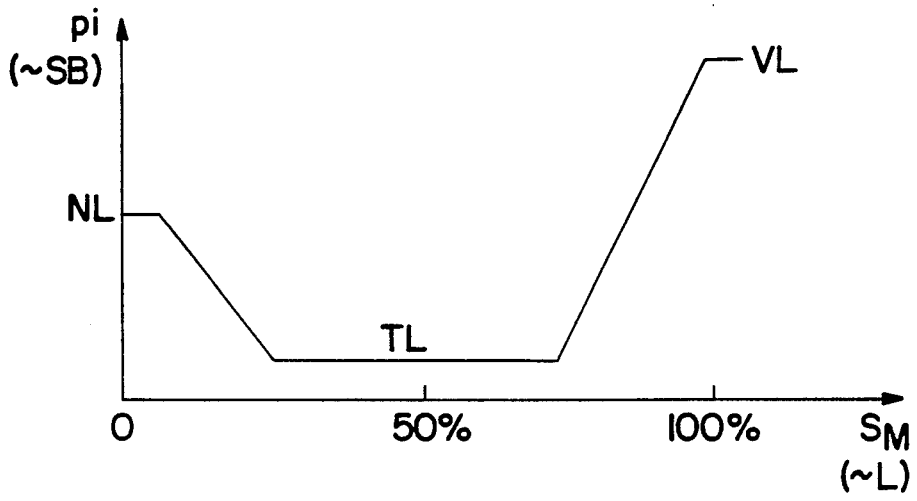
Figure 7:
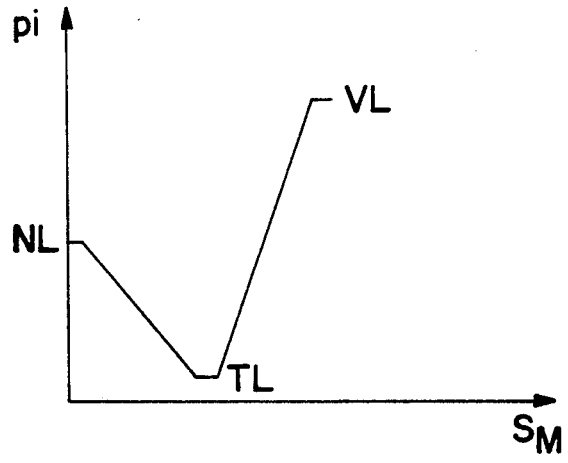

FIGS. 3*a*, 3*b*, and 3*c* show part of a longitudinal section of the governor sleeve and the governor axis in accordance with a further example in three different displacement positions of the governor sleeve;

FIG. 4 shows part of an opened-up view of the sleeve of the governor sleeve in FIG. 3;

FIGS. 5*a*, 5*b*, and 5*c* show an enlarged part view of a longitudinal section of the governor axis with the respective opened-up view of the outer sleeve of the governor sleeve, in accordance with a third example in three different displacement positions of the governor sleeve;

FIG. 6 shows a diagram of the control pressure progression $p_i$ in the pump body of the fuel injection pump in FIG. 1, in relation to the displacement path $s_M$ of the governor sleeve, in the case of a governor sleeve in accordance with FIG. 2;

FIG. 7 shows a diagram of the progression of the control pressure $p_i$ in the pump body of the fuel injection pump in accordance with FIG. 1, in relation to the displacement path $s_M$ of the governor sleeve, in the case of a governor sleeve in accordance with FIGS. 3*a*, 3*b*, and 3*c*, or FIGS. 5*a*, 5*b*, and 5*c*.

DESCRIPTION OF THE EXAMPLES

In the case of the fuel injection pump of the distributor type construction, represented schematically in longitudinal section in FIG. 1, a pump plunger 11 which also serves as a distributor is set into a simultaneous rotary motion and into a reciprocating motion by means of a driveshaft 12 and a cam drive 13. At each pressure stroke of the pump plunger 11, fuel is delivered from the pump work chamber 14 via a distributing longitudinal groove 15 to one of several pressure ducts 16, which are arranged around the pump plunger 11 at regular angular displacements, and which each lead to a combustion chamber, not shown, of an internal combustion engine.

The pump work chamber 14 is supplied with fuel via an intake duct 17 leading from a fuel-filled pump body 18 in the housing 10 of the fuel injection pump to the pump cylinder, whereby during the intake stroke of the pump plunger 11, the intake duct 17 is opened via control grooves 15 to the pump work chamber 14 and a linear blind bore 15' is disposed in the pump piston which communicates with the work chamber 14. Branching off from the blind bore is a distributor bore 19' which during each stroke of the piston, connects the pump work chamber via a control groove 19 to one of equally distanced pressure ducts 16 in turn. The number of pressure strokes executed per revolution of the pump plunger 11 corresponds to the number of pressure ducts 16. A solenoid valve 20 is arranged in the intake duct 17; this solenoid valve blocks the intake duct 17 to terminate the injection and to switch off fuel flow to the internal combustion engine.

The amount of fuel delivered per stroke of the pump plunger 11 into each of the pressure ducts 16 is determined by the axial position of an injection quantity control element or control slider 21, which is located on the pump plunger 11 and is axially movable. Its axial position is set by a speed governor 22 and a setting lever 23 which can be adjusted at will, the respective r.p.m. and load being evaluated. The load is determined by the position of the accelerator pedal of the vehicle in relation to its running resistances.

The pump body 18 is supplied with fuel by a feed pump 24, which is driven by the drive shaft 12, and which takes in fuel from a fuel tank 25 via a suction pipe 26. The output pressure of the feed pump 24 and thus the pressure $p_i$ in the pump body 18 is controlled via a pressure control valve 27, this pressure rising with increasing speed of the drive shaft 12 in accordance with a desired function The pump body 18 houses both the cam gear 13 and the speed governor 22. They are thus pressurized on all sides by the pressure $p_i$ in the pump body 18, referred to below as control pressure, and are lubricated by the fuel.

The cam gear 13 has a roller ring 29 carrying rollers 28, this roller ring being pivotable about a certain angle in the housing, and which is positively coupled to an injection timing piston 32 of an injection timing mechanism 30, via an adjusting bolt 31. In FIG. 1, the injection timing piston 32 is shown rotated 90° in the plane of projection. The injection timing piston 32, which is axially movable tangential to the roller ring 29, is pressurized in one adjustment direction by a spring 33, and in the other adjustment direction by the control pressure of the pump body 18 prevailing in a pump clearance volume 34. The clearance volume 34 and the pump body 18 are connected with one another via a throttle duct 35 in the injection timing piston 32. If the control pressure in the pump body 18 rises with increasing speed, then the injection timing piston 32 is pushed against the pressure spring 33, and the roller ring 29 is slewed around. In the inner bore of the roller ring 29 there is a claw coupling, in which claws of the drive shaft 12 engage with claws of the pump plunger 11, so that the pump plunger 11 can execute a stroke movement independently of the drive shaft 12 during rotation. Located on the pump plunger 11 is a lifting or frontal cam disk 36, the frontal cams of which run on the rollers 28, the number of cams corresponding to the number of pressure ducts 16. When the injection timing piston 32 is displaced against the spring 33, the roller ring 29 is slewed in such a way that the frontal cams of the cam disk 36, relative to the rotation position of the drive shaft 12, engage earlier with the rollers 28, due to which the stroke commencement of the pump plunger 11 and thus the start of delivery of the fuel, and the start of injection SB take place earlier in relation to the rotational position of the drive shaft 12. Thus the higher the control pressure in the pump body 18, and at the injection timing piston 32, the earlier will be the start of injection SB.

The speed governor 22 is driven via a toothed wheel 37 which is firmly connected to the drive shaft 12, and which drives a speed sensor 38 with centrifugal weights 39. The centrifugal weights 39 engage with a governor sleeve 40 which is located, axially movable, on a governor axis 41. With its free end, the governor sleeve 40 contacts a fulcrum lever system 43 which is tensioned via a control spring 42; this fulcrum lever system operates the control slider 21. The fulcrum lever system 43 is pivoted on an axis 44. The preloading of the control spring 42 can be set by means of the adjusting lever 23, in such a way that when the adjusting lever 23 is moved in the direction of increasing load, the control slider 21 in FIG. 1 is pushed upwards, and the fuel injection pump is thus enlarged.

To enable change of commencement of delivery in a load controlled manner, which has previously been described only in a speed-dependent manner, a relief throttle 45 in the pump body 18 is controlled by the governor sleeve 40 in such a way that, depending on the load-controlled displacement setting of the governor sleeve 40, a different throttle cross-section is uncovered to an outlet duct 46, implemented in the governor axis 41 as an axial hole. By means of this restricted opening action of the outlet duct 46, the pressure in the pump body 18 can be reduced, through which the injection timing piston 32 moves back under the pressure of spring 33, and by turning the roller ring 29, adjusts the start of delivery or start of injection SB in the direction of "late". The outlet channel 46 is connected with the fuel tank 25 via a outlet pipe 47.

An enlarged view of the governor sleeve 40 with governor axis 41 is shown in FIG. 2. The hollow governor sleeve 40, the end of which is closed with a cap 51, carries the relief throttle 45 which, by moving the governor sleeve 40 on the governor axis 41, uncovers a larger or smaller amount of aperture towards the outlet duct 46. Three notable displacement settings of the governor sleeve are indicated in FIG. 2 by broken lines, and marked VL (full load), TL (part load) and NL (no-load or idling). The governor sleeve 40 is moved to these settings via the centrifugal weights 39 when, as a result of the load on the internal combustion engine being relieved, its speed, and thus the speed of the drive shaft 12, increases. The relief throttle 45 has two holes 48 and 49 drilled radially at an axial displacement in the governor sleeve 40; these holes have widely differing diameters and work jointly in conjunction with a transverse hole 50 through the governor axis. The transverse hole 50 is connected with a first annular groove 55 in the governor axis 41 via an axial blind bore 52, which is closed at the front end of the governor axis 41 by means of a plug 53, and via a radial bore 54 breaking into the blind bore 52. At an axial distance from the first annular groove 55, a second annular groove 56 is provided on the governor axis 41, which is connected with the outlet duct 46 via a second radial bore 57. A connecting annular groove 58 in the governor sleeve 40 acts in conjunction with the two annular grooves 55 and 56. The connecting annular groove 58 is dimensioned and displaced in such a way that it separates the two annular grooves 55 and 56 from one another in the full load setting (VL) of the governor sleeve 40, and connects them with one another in the other displacement positions of the governor sleeve 40 (TL and NL). The two radial bore 48 and 49 in the governor sleeve 40 and the transverse bore 50 in the governor axis 41 are related to each other in such a way that in the part load setting (TL) of the governor sleeve the radial bore 48 with the larger diameter connects with the transverse bore 50, and in the no-load setting (NL), the radial bore 49 with the smaller diameter connects with the transverse bore 50. In the part load setting (TL), a relatively large amount of fuel flows out via the large cross-section of the radial bore 48 into the outlet duct 46, so that the pressure in the pump body 18 is substantially lowered. The displacement path of the injection timing piston 32 is correspondingly large under the action of the spring 33; and due to the consequential slewing of the roller ring 29, the start of injection is substantially moved towards "late". In the no-load setting (NL), the relief throttle is restricted to the smaller aperture of the radial bore 49, so that considerably less fuel can flow out and the pressure in the pump body 18 again increases. The injection timing piston 32 is pushed against its spring 33, and once again adjusts the start of injection in the direction of "early". However, since the fuel is still flowing with a restricted flow via the radial bore 49 with the smaller cross-section, the pressure in the pump body 18 will not rise so sharply as in the full-load setting (VL) of the governor sleeve 40, in which the connecting groove 58 separates the linking of the radial bore 48 and 49 to the outlet duct 46. The progression of the pressure $p_i$ in the pump body 18 is represented in relation to the displacement path $s_M$ of the governor sleeve 40 in FIG. 6. At full-load (VL) it is very high, decreases sharply in the part load range, and increases in the no-load range (NL) to approximately half the pressure of the full-load range. This diagram also essentially corresponds to the progression of the injection time (start of injection SB) in relation to the load (L), where the start of injection (SB), starting from the abscissa, moves from "late" to "early".

In FIGS. 3*a*, 3*b*, 3*c*, and 4, a further example of the relief throttle 45 in the governor sleeve 40 is shown. FIG. 3*a* shows the governor sleeve 40 in the full-load setting (VL), FIG. 3*b* in the part load setting (TL), and FIG. 3*c* in the no-load setting (NL). FIG. 4 shows the opened-up view of the outer cover of the governor sleeve 40. The relief throttle 45 has numerous cutouts 61 and 62, which are arranged in the governor sleeve 40, and fully penetrate the sleeve wall, and are adjacent to each other in two cross-sectional planes, circumferentially. All the cutouts 61 and 62 are of the same cross-section, albeit with the number of cutouts 61 in one of the planes being twice the number of the cutouts 62 in the other plane. The governor axis 41 has an annular groove 63, connected with the outlet duct 46 via a transverse hole 60, the axial groove width of this annular groove being dimensioned large enough to be able to cover the cutouts 61 and 62 in both planes. The cutouts 61 and 62 and the annular groove 63 are now arranged in such a way that in the full load setting of the governor sleeve 40 (FIG. 3*a*) the annular groove 63 covers only the smaller number of cutouts 62 in the one plane; in the part load setting (FIG. 3*b*) it covers all cutouts 61 and 62; and in the no-load setting (FIG. 3*c*) it covers the larger number of cutouts 61 in the other plane. Thus the relief throttle 45 connects the pump body 18 with the outlet duct 46 in the full load setting via a small throttle cross section which is formed by the cutouts 62; in the part load setting via a very large cross section which is formed by the sum of the cutouts 61 and 62; and in the no-load setting once again via a smaller throttle cross section which, however, is twice as large as the throttle cross section in the full load setting and which is formed by the cutouts 62 in the second cross sectional plane. The progression of the control pressure $p_i$ in the pump body 18, during the described displacement of the governor sleeve 40, is represented in FIG. 7, in relation to its displacement path $s_M$. In place of the differing number of cutouts 61 and 62 in the two cross-sectional plans, differing sizes (or sizes and numbers) of cutouts can be chosen. The one thing to be ensured is that the total cross-sectional area of flow prevailing in the cross-sectional plane of the cutouts 61 is correspondingly larger than the cross-sectional area of flow available in the plane of recesses 62.

A further design example of the relief throttle 45 in the governor sleeve 40 is illustrated in FIGS. 5*a*, 5*b*, and 5*c*. In the lower part of FIGS. 5*a*, 5*b*, and 5*c* the governor axis 41 is shown, and in the upper diagram the opened-up view of the cover surface of the governor sleeve 40 which is located axially movable, on the governor axis 41. In FIG. 5, the position of the governor sleeve 40 relative to the governor axis 41 for the full-load setting (FIG. 5*a*), for the part load setting (FIG. 5*b*), and for the no-load setting (FIG. 5*c*) is shown. The relief throttle 45 has a number of cutouts 71 and 72 which are arranged in the governor sleeve 40 and which fully penetrate the sleeve wall; these cutouts extend in an axial direction and lie in the same cross-sectional plane, with a frontal limiting edge. Viewed in the direction of the circumference, they are randomly spaced from one another. The cutouts 71 and 72 are divided into two groups, whereby in each group the recesses 71 or 72 have the same cross section. Viewed in the circumferential direction, all cutouts 71 and 72 have the same width, but the cutouts 71 of the one group have a greater axial extension than the cutouts 72 of the other group. The governor axis 41 has an annular groove 73, the axial groove width of which is dimensioned to be the same size as the axial length of the cutouts 72. The annular groove 73 is connected with the outlet duct 46 via four radially drilled holes 74. The cutouts 71 and 72 and the annular groove 73 are related to one another in such a way that when the governor sleeve 40 is in the full load setting (FIG. 5*a*) the annular groove 73 does not cover any of the cutouts 71 and 72; that in the part load setting (FIG. 5*b*) it corresponds with all the cutouts 71 and 72; and that in the no-load setting (FIG. 5*c*) it corresponds only with the cutouts 71 of the group with the larger axial length. The penetration areas, uncovered in each case by the annular groove 73 to the outlet duct 46, for the outflow of fuel from the pump body 18 are shown as hatched in FIGS. 5*a*, 5*b*, and 5*c*. Since the number of cutouts 71 and 72 is the same in each group, the sum of the penetration areas for the fuel in the part load setting of the governor sleeve (FIG. 5*b*) is thus twice as great as in the no-load setting (FIG. 5*c*). In the full load setting (FIG. 5*a*), there is no connection between the pump body 18 and the outlet duct 46. The progression of the control pressure $p_i$ in the pump body 18 in relation to the displacement path $s_M$ of the governor sleeve 40 can be seen again in FIG. 7.

In the example of the relief throttle described above, it is not absolutely necessary for the axial groove width of the annular groove 73 to be equal to the axial length of the shorter cutouts 72. In general, the groove width of the annular groove 73 must be dimensioned equal to or smaller than the maximum displacement path of the governor sleeve 40, reduced by the axial length of the shorter cutouts 72 and by the sum of the required spacing dimensions of the frontal limiting edges of the shorter cutouts 72 of the annular groove 73 in the full load or part load setting of the governor sleeve 40. Spacing dimensions in this sense describes the additional displacement path of the governor sleeve 40, in order to ensure, in accordance with congruence of the control edge of the annular groove 73 and the limiting edge of the shorter cutouts 72, reliable covering of the shorter cutouts 72 by the Governor axis 41. The shorter cutouts 72 are opened by the left control edge of the annular groove in FIGS. 5*a*, 5*b*, and 5*c*, and closed again by the right control edge. The longer cutouts 71 are opened by the left control edge, and in accordance with a displacement path of the governor sleeve 40, which corresponds to the groove width of the annular groove 73 plus an overlap to be taken into account in the full load setting of the governor sleeve 40, provide a constant control-cross section when the governor sleeve 40 is moved in the no-load direction.

If the axial length of the shorter cutouts 72 are designed smaller than the groove width of the annular groove 73, a wider part load range TL can be obtained. Two designs are possible. In the first design, the frontal limiting edge of the shorter cutouts 72 are not in the same plane as the limiting edges of the longer cutouts 71. In this case, the progression of control pressure $p_i$ in the pump body 18 corresponds to the dashed line curve in FIG. 7.

In the second design, the limiting edges of short and long cutouts 71 and 72 lie in the same cross-sectional plane. The progression of the control pressure $p_i$ in relation to the displacement path $s_M$ of the governor sleeve 40 corresponds to the dashed line in FIG. 7. The gradient of the individual ranges of the progression $p_i=f(s_M)$ can be varied by means of correspondingly chosen width of the cutouts 71 and 72, viewed in the direction of the circumference of the governor sleeve 40.

We claim:

1. A fuel injection pump of distributor type construction for internal combustion engines with a distributor plunger which restricts a pump work chamber, this distributor plunger being driven by a drive shaft in a reciprocating and simultaneously rotating movement; an injection quantity control element which is axially movable on the distributor plunger; a speed governor which actuates the injection quantity control element, this speed governor having a speed-dependent, moving governor sleeve; a hydraulic injection timing mechanism which has an injection timing piston which is pressurized by a control pressure, this injection timing piston adjusting the stroke start of the distributor plunger and thus the start of delivery or start of injection (SB) with reference to the rotational position of the drive shaft to "early" with increasing pressure and to "late" with decreasing pressure; a pump body, containing the speed governor, said pump body is filled with fuel at control pressure and which is connected with the injection timing piston and has a relief throttle which is load-controlled by the governor sleeve, this relief throttle releasing a varying throttle cross section, depending on the displacement position of the governor sleeve, to an outlet channel at the pump body the relief throttle (45) in the governor sleeve (40) is designed in such a way that the throttle cross section uncovered to the outlet duct (46) when the displacement setting which the governor sleeve (40) assumes at full load (VL) is zero; that the part load setting (TL) assumed by the governor sleeve (40) on relief is large; and that in a no-load or idling setting (NL) which is adopted by the governor sleeve (40) on further relief, is again smaller.

2. A pump in accordance with claim 1, in which the governor sleeve (40) is positioned, axially movable, on a governor axis (41) which contains the outlet duct (46) in the form of an axial bore; the relief throttle (45) has two radial bores (48, 49), drilled in the governor sleeve (40), axially spaced, with greatly differing diameters, which work together with a transverse hole (50) in the governor axis (41); the transverse hole (50) is connected with a first annular groove (55) in the controller axis (41), located at an axial distance from it; the outlet duct (46) terminates in a second annular groove (56) arranged at an axial distance from the first annular groove (55); a connecting groove (58) is located in the governor sleeve (40) in such a relation to the first and second annular grooves (55, 56) that in the full load setting (VL) of the governor sleeve (40) it separates said first and second annular grooves (55, 56) from one another, and connects them with one another in another displacement position of the governor sleeve (40); and the two radial bores (48, 49) in the governor sleeve (40) and the transverse bore (50) in the governor axis (41) are arranged in relation to one another such that in a part load setting (TL) of the governor sleeve (40), the radial hole (48) with the larger diameter is connected with the transverse hole (50), and that in the no-load or idling setting (NL) of the governor sleeve (40), the radial bore (49) with the smaller diameter is connected with the transverse bore (50).

3. A pump in accordance with claim 1, in which the governor sleeve (40) is located, axially movable, on a governor axis (41) which contains the outlet duct (46) as an axial bore; the relief throttle (45) has numerous cutouts (61, 62) arranged in the governor sleeve (40) which penetrate the sleeve wall and which lie adjacent to each other with separation, in two cross-sectional planes, the number of cutouts (61, 62) or their size in each plane differing widely; the governor axis (41) has an annular groove (63) which is connected with the outlet bore (46) and which has an axial groove width that is dimensioned in such a way that the axial groove width can cover the cutouts (61, 62) in both cross-sectional planes; and that the cutouts (61,1 62) and the annular groove (63) are arranged in such a way that in the full load setting (VL) of the governor sleeve (40) the annular groove (63) covers only the fewer or smaller diameter cutouts (62) in the one plane, in the part load setting (TL) it covers all cutouts (61, 62), and in the no-load setting (NL) it covers the larger number of cutouts or those with the larger diameter (61) in the other plane.

4. A pump in accordance with claim 3, in which the cutouts in both cross-sectional planes are designed with equal cross section, and that the number of cutouts (61) in the one plane is twice that of the number of cutouts (62) in the other plane.

5. A pump in accordance with claim 1, that governor sleeve (40) is positioned, axially movable, on a governor axis (41) which contains the outlet bore (46) in the form of an axial bore; the relief throttle (45) has numerous cutouts (71, 72) arranged in the governor sleeve (40) which penetrate the sleeve wall and which lie adjacent to one another, with spacing, in the circumferential direction in a cross-sectional plane and extend in an axial direction; there are at least two groups of cutouts (71, 72), of which the cutouts (71) of the one group have a longer axial extension than the cutouts (72) of the other group; that the governor axis (41) has a annular groove (73) which is connected with the outlet bore (46), and which has an axial groove width equal to or smaller than the maximum displacement path of the governor sleeve (40) reduced by the axial length of the shorter cutouts (72) and by the sum of the required spacing dimensions of the shorter cutouts (72) of the annular groove (73) in the full load and part load setting of the governor sleeve (40); and that the cutouts (71, 72) and the annular groove (73) are related to each other in such a way that in the full load setting (VL) of the governor sleeve (40) the annular groove (73) does not cover any of the cutouts (71, 72), in the part load setting (TL) it is connected with all cutouts (71, 72), and in the no-load setting it is connected only with the cutouts (71) of the one group with the longer axial extension.

6. A fuel injection pump of distributor type construction for internal combustion engines with a distributor plunger which restricts a pump work chamber, this distributor plunger being driven by a drive shaft in a reciprocating and simultaneously rotating movement; an injection quantity control element which is axially movable on the distributor plunger; a speed governor which actuates the injection quantity control element, this speed governor having a speed-dependent, moving governor sleeve; a hydraulic injection timing mechanism which has an injection timing piston which is pressurized by a control pressure, this injection timing piston adjusting the stroke start of the distributor plunger and thus the start of delivery or start of injection (SB) with reference to the rotational position of the drive shaft to "early⇄ with increasing pressure and to "late" with decreasing pressure; a pump body, containing the speed governor, said pump body is filled with fuel at control pressure and which is connected with the injection timing piston and has a relief throttle which is load-controlled by the governor sleeve, this relief throttle releasing a varying throttle cross section, depending on the displacement position of the governor sleeve, to an outlet channel at the pump body the relief throttle (45) in the governor sleeve (40) is designed in such a way that the throttle cross section uncovered to the outlet duct (46) when the displacement setting which the governor sleeve (40) assumes at full load (VL) is very small; that the part load setting (TL) assumed by the governor sleeve (40) on relief is large; and that in a no-load or idling setting (NL) which is adopted by the governor sleeve (40) on further relief, is again smaller.

7. A pump in accordance with claim 6, in which the governor sleeve (40) is positioned, axially movable, on a governor axis (41) which contains the outlet duct (46) in the form of an axial bore; the relief throttle (45) has two radial bores (48, 49), drilled in the governor sleeve (40), axially spaced, with greatly differing diameters, which work together with a transverse hole (50) in the governor axis (41); the transverse hole (50) is connected with a first annular groove (55) in the controller axis (41), located at an axial distance from it; the outlet duct (46) terminates in a second annular groove (56) arranged at an axial distance from the first annular groove (55); a connecting groove (58) is located in the governor sleeve (40) in such a relation to the first and second annular grooves (55, 56) that in the full load setting (VL) of the governor sleeve (40) it separates said first and second annular grooves (55, 56) from one another, and connects them with one another in another displacement position of the governor sleeve (40); and the two radial bores (48, 49) in the governor sleeve (40) and the transverse bore (50) in the governor axis (41) are arranged in relation to one another such that in a part load setting (TL) of the governor sleeve (40), the radial hole (48) with the larger diameter is connected with the transverse hole (50), and that in the no-load or idling setting (NL) of the governor sleeve (40), the radial bore (49) with the smaller diameter is connected with the transverse bore (50).

8. A pump in accordance with claim 6, in which the governor sleeve (40) is located, axially movable, on a governor axis (41) which contains the outlet duct (46) as an axial bore; the relief throttle (45) has numerous cutouts (61, 62) arranged in the governor sleeve (40) which penetrate the sleeve wall and which lie adjacent to each other with separation, in two cross-sectional planes, the number of cutouts (61, 62) or their size in each plane differing widely; the governor axis (41) has an annular groove (63) which is connected with the outlet bore (46) and which has an axial groove width that is dimensioned in such a way that the axial groove width can cover the cutouts (61, 62) in both cross-sectional planes; and that the cutouts (61,1 62) and the annular groove (63) are arranged in such a way that in the full load setting (VL) of the governor sleeve (40) the annular groove (63) covers only the fewer or smaller diameter cutouts (62) in the one plane, in the part load setting (TL) it covers all cutouts (61, 62), and in the no-load setting (NL) it covers the larger number of cutouts or those with the larger diameter (61) in the other plane.

9. A pump in accordance with claim 8, in which the cutouts in both cross-sectional planes are designed with equal cross section, and that the number of cutouts (61) in the one plane is twice that of the number of cutouts (62) in the other plane.

10. A pump in accordance with claim 6, that governor sleeve (40) is positioned, axially movable, on a governor axis (41) which contains the outlet bore (46) in the form of an axial bore; the relief throttle (45) has numerous cutouts (71, 72) arranged in the governor sleeve (40) which penetrate the sleeve wall and which lie adjacent to one another, with spacing, in the circumferential direction in a cross-sectional plane and extend in an axial direction; there are at least two groups of cutouts (71, 72), of which the cutouts (71) of the one group have a longer axial extension than the cutouts (72) of the other group; that the governor axis (41) has a annular groove (73) which is connected with the outlet bore (46), and which has an axial groove width equal to or smaller than the maximum displacement path of the governor sleeve (40) reduced by the axial length of the shorter cutouts (72) and by the sum of the required spacing dimensions of the shorter cutouts (72) of the annular groove (73) in the full load and part load setting of the governor sleeve (40); and that the cutouts (71, 72) and the annular groove (73) are related to each other in such a way that in the full load setting (VL) of the governor sleeve (40) the annular groove (73) does not cover any of the cutouts (71, 72), in the part load setting (TL) it is connected with all cutouts (71, 72), and in the no-load setting it is connected only with the cutouts (71) of the one group with the longer axial extension.

* * * * *